US008439715B1

(12) United States Patent
Clark

(10) Patent No.: US 8,439,715 B1
(45) Date of Patent: May 14, 2013

(54) TROLLING MOTOR SUPPORT ASSEMBLY

(76) Inventors: James F. Clark, Amity, AR (US); Margaret Clark, legal representative, Amity, AR (US)

( * ) Notice: Subject to any disclaimer, the term of this patent is extended or adjusted under 35 U.S.C. 154(b) by 130 days.

(21) Appl. No.: 12/983,952

(22) Filed: Jan. 4, 2011

Related U.S. Application Data

(60) Provisional application No. 61/292,019, filed on Jan. 4, 2010.

(51) Int. Cl.
*B60L 11/00* (2006.01)

(52) U.S. Cl.
USPC ..... 440/6; 440/60; 440/65

(58) Field of Classification Search ..... 440/6, 60, 440/65; 248/640–643
See application file for complete search history.

(56) References Cited

U.S. PATENT DOCUMENTS

| | | | | |
|---|---|---|---|---|
| 3,980,039 | A * | 9/1976 | Henning | 440/6 |
| 4,708,670 | A * | 11/1987 | Peters | 440/6 |
| 5,607,136 | A * | 3/1997 | Bernloehr | 248/640 |
| 6,431,923 | B1 * | 8/2002 | Knight et al. | 440/6 |
| 6,524,144 | B2 * | 2/2003 | Pasley | 440/6 |
| 7,399,211 | B1 * | 7/2008 | Spaulding | 440/6 |

* cited by examiner

*Primary Examiner* — Stephen Avila
(74) *Attorney, Agent, or Firm* — J. Charles Dougherty

(57) ABSTRACT

A support assembly for a trolling motor is disclosed whereby the trolling motor shaft is clamped into a separate threaded rack unit. A motor driving a gear engaged with the rack unit causes the trolling motor to be raised and lowered vertically. A spring is employed in the breakaway mounting assembly to allow the trolling motor propulsion unit to deflect upon striking an underwater obstacle, and thereby prevent damage to the trolling motor.

17 Claims, 1 Drawing Sheet

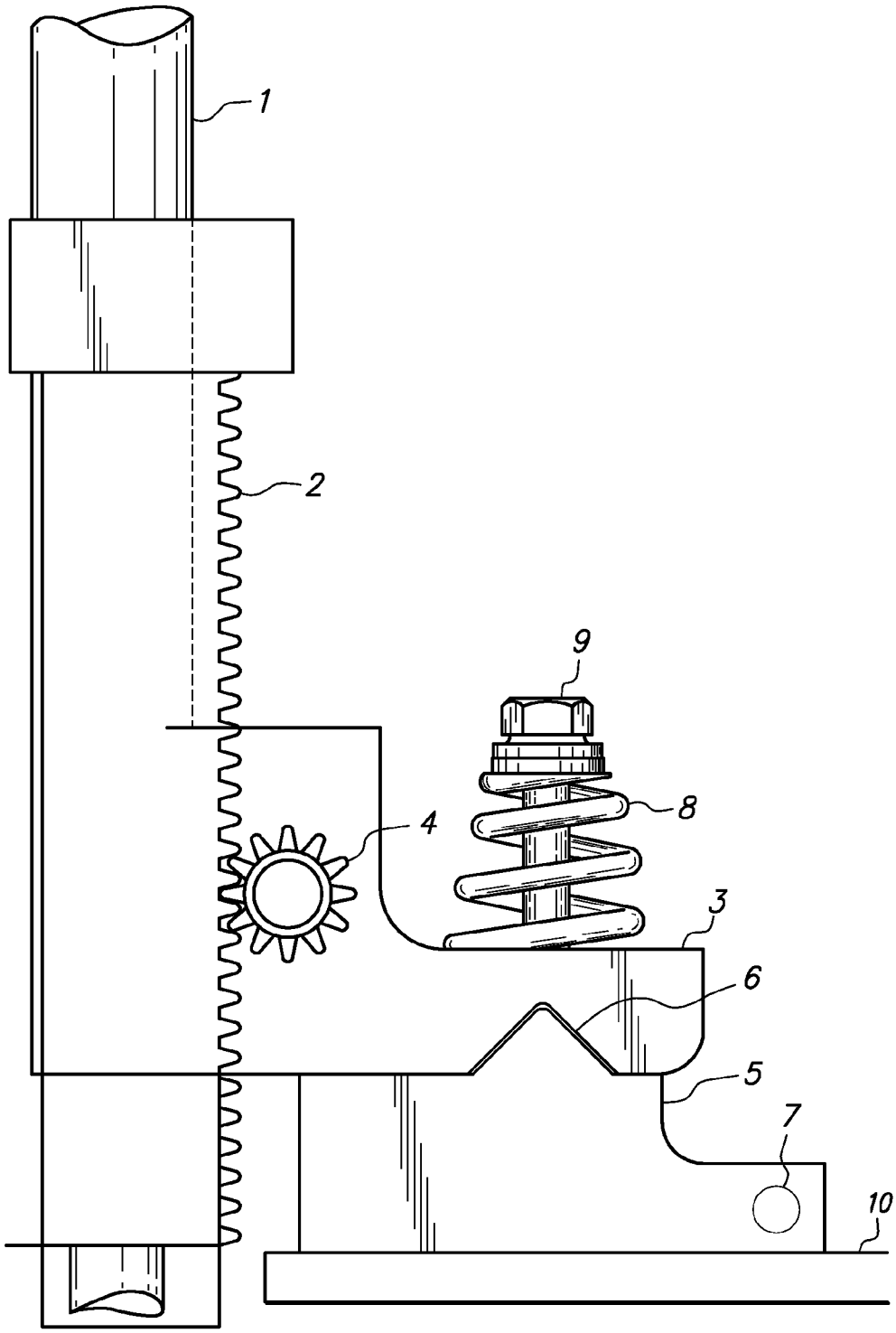
1
2
9
8
4
3
6
5
7
10

TROLLING MOTOR SUPPORT ASSEMBLY

CROSS-REFERENCE TO RELATED APPLICATIONS

This application claims the benefit of U.S. provisional patent application No. 61/292,019, filed on Jan. 4, 2010, such application being incorporated herein by reference.

STATEMENT REGARDING FEDERALLY SPONSORED RESEARCH OR DEVELOPMENT

Not applicable.

BACKGROUND OF THE INVENTION

The present invention relates to a support assembly for an outboard trolling motor, and in particular relates to such an assembly that provides a convenient and reliable means to raise the motor from the water and lower the motor into the water while operating a boat.

Outboard trolling motors are widely employed for the purpose of maneuvering a small boat over short distances. Such motors are very popular with fishermen because they allow a fisherman to approach desired fishing areas very closely at low speed, with very little disturbance of the surrounding water. The motors allow the fisherman to remain relatively motionless over a desired fishing location, despite wind or other factors that would tend to push the boat away. Such motors also allow the fisherman to slowly and quietly move about in a small area while fishing the entire area as the boat is slowly moved. The motors typically produce almost no noise or vibration because they are powered electrically, generally driven from a battery maintained on the boat. The battery may be dedicated to the trolling motor or, more commonly, serve the dual purpose of driving the trolling motor and providing a source for an electrical start function for the main drive motor. Trolling motors are ideal for use in areas where projections or obstacles may be encountered, which require finely-tuned maneuvering of the boat to avoid damage. Many game fish prefer such areas, and thus trolling motors are employed on the great majority of high-end fishing boats, particularly those boats employed by professional fishermen.

A typical trolling motor comprises three main components. A propeller-driven propulsion unit is positioned under the water during use. The propulsion unit provides the drive that actually pushes or pulls the boat in the desired direction. A shaft attaches to the propulsion unit and extends up out of the water, providing a connection point between the trolling motor and the boat. A head unit is generally positioned at the top of the support assembly in order to provide a steering mechanism. The steering mechanism may be either electrically powered or manual. A manually steered unit may comprise a handle that extends from the head, allowing the operator to turn the support assembly shaft and, as a result, change the direction of the propeller of the propulsion unit with respect to the boat. As an alternative, electrical turning controls may be included, which are typically operated by a foot pedal, allowing for the hands-free operation preferred by many fishermen so that they may simultaneously move the boat and fish. Trolling motors are usually attached at either the bow or the stern of the boat, as desired by the operator, but are more often mounted at the bow. One purpose for this mounting position is to avoid interference with an outboard or inboard/outboard main drive unit, which is typically mounted at the stern of a fishing boat.

To avoid drag and potential damage to the trolling motor, a trolling motor must be removed from the water when the boat is operated at speed under the propulsion of its main drive unit. Once the boat approaches the general area of the operator's destination, such as a fishing spot identified by the operator, the main drive unit is shut off and the trolling motor must be lowered into the water. This operation should ideally be performed as silently as possible, with a minimum of water disturbance in order to avoid frightening fish in the immediate area of the boat. The operation should also be performed as quickly as possible, particularly when the operator is a professional fisherman competing in a timed fishing event or tournament. In a typical trolling motor mounting arrangement, removing the trolling motor from the water requires that the trolling motor head be pulled back over the boat, and the propulsion unit rotationally lifted from the water and pulled back onto the boat by movement of the shaft up and over the side of the boat. The reverse operation is required for placement of the trolling motor into the water when a desired location is reached.

While in some trolling motor units this raising and lowering operation must be performed manually, other trolling motors include a geared system providing a motor-operated function to raise and lower the trolling motor. An example of this latter type of arrangement is taught in U.S. Pat. No. 3,980,039 to Henning. Such prior art systems as taught by Henning result in a cumbersome mechanism for raising and lowering a trolling motor. A large amount of space in the boat must be dedicated to placement of the trolling motor in a horizontal position once the trolling motor is raised from the water.

In addition, the prior art systems provide no effective protection for the trolling motor should an underwater obstacle be struck during operation of the boat. Striking an obstacle during operation is a common occurrence, since trolling motors are often operated in areas where underwater obstructions are frequently encountered, such as near the bank of a body of water or near a submerged tree. Although the boat is typically moving at low speed when this occurs, trolling motor propulsion units are small and fragile, and even a low-speed collision with an underwater obstacle may render a trolling motor inoperable.

What is desired then is an improved support assembly for a trolling motor that overcomes each of these disadvantages.

BRIEF SUMMARY OF THE INVENTION

In one aspect, the present invention is directed to a trolling motor support assembly for a trolling motor comprising a trolling motor propulsion unit and trolling motor shaft, the support assembly comprising a rack unit attached to the trolling motor shaft, wherein the rack unit comprises a vertically disposed rack, a breakaway unit comprising a gear engaged with the rack of the rack unit, whereby rotation of the gear causes the trolling motor shaft to raise or lower depending upon a direction of rotation of the gear, and a breakaway base beneath the breakaway unit, wherein the breakaway unit and breakaway base are resiliently engaged with each other such that the trolling motor propulsion unit may deflect if it strikes an underwater obstacle.

In another aspect, the present invention is directed to a drive assembly for a boat, comprising a trolling motor comprising a trolling motor shaft and a trolling motor propulsion unit, wherein the trolling motor shaft comprises a vertically disposed rack, a breakaway unit comprising a gear engaged with the trolling motor shaft rack, whereby rotation of the gear causes the trolling motor shaft to raise or lower depending upon a direction of rotation of the gear, and a breakaway base beneath the breakaway unit, wherein the breakaway unit and breakaway base are resiliently engaged with each other such that the trolling motor propulsion unit may deflect if it strikes an underwater obstacle.

In still another aspect, the present invention is directed to a trolling motor support assembly for a trolling motor comprising a trolling motor shaft, comprising a rack attached to the trolling motor shaft, wherein the rack comprises a plurality of vertically disposed teeth a gear engaged with the teeth of the rack, a gear motor engaged with the gear whereby the gear motor may drive the gear rotationally, an electrical control system in communication with the gear motor operable to turn the gear and to control the direction in which the gear is turned, a breakaway unit housing the gear and the gear motor, a breakaway base positioned beneath the breakaway unit, a plurality of cams extending upward from the breakaway base, a plurality of notches on a lower side of the breakaway unit and positioned to each receive one of the plurality of cams extending upward from the breakaway base, a spring retaining assembly extending upward through the breakaway unit from the breakaway base, and a spring attached to the spring retaining assembly wherein the spring is operable to urge the breakaway unit downward such that the cams of the breakaway base are engaged with the notches of the breakaway unit.

BRIEF DESCRIPTION OF THE DRAWING

FIG. 1 is a side elevational view, in partial cut-away, showing a preferred embodiment of the present invention.

DETAILED DESCRIPTION OF THE PREFERRED EMBODIMENT

With reference to FIG. 1, the preferred embodiment of the present invention may now be described. Trolling motor shaft 1 is of the conventional type used on numerous trolling motors that may be employed for use with the preferred embodiment. A propeller-driven propulsion unit as known in the art (not shown) is attached at the bottom of shaft 1. Likewise, a head unit as known in the art (also not shown) may be connected at the top of shaft 1 to provide an electrical and/or manual turning function for the trolling motor. Electrical connecting wires between the head unit and the propulsion unit may preferably be passed through the hollow interior of shaft 1. Fitted around trolling motor shaft 1 is trolling motor clamp and rack unit 2. The clamp section at the top of rack unit 2 securely connects shaft 1 to rack unit 2, thereby allowing the trolling motor to be raised and lowered in response to vertical movement of rack unit 2.

Breakaway unit 3 includes a gear motor (not shown) that drives gear 4, which is housed within breakaway unit 3. It may be seen in FIG. 1 that gear 4 of breakaway unit 3 engages the toothed rack portion of rack unit 2. In this way, driving of gear 4 causes vertical movement of rack unit 2, and thus of the trolling motor because shaft 1 is clamped to rack unit 2. The direction in which gear 4 is turned will determine whether the trolling motor is raised or lowered. In this manner, the rotation of gear 4 results in the raising of the trolling motor propulsion unit out of the water for travel between desired fishing areas, or the lowering of the trolling motor propulsion unit into the water for precise control of the boat when the desired fishing area is reached. The raising and lowering of the trolling motor propulsion unit in this manner through the rotation of gear 4 may be accomplished, for example, by electrical controls connected to the gear motor, such as by means of a foot pedal, or may be accomplished by means of a wireless remote control mechanism. Because the propulsion unit is being lowered into the water in a direct vertical fashion, rather than in a sideward motion as with traditional trolling motor lift mechanisms, the noise and water disturbance associated with the operation will be minimized. This feature is highly desirable for fishermen. The constant velocity of the movement also serves to minimize the possible disturbance of fish in the area. Both the rotation of the propulsion unit and the raising and lowering of the propulsion unit may be accomplished simultaneously, thereby providing the fastest possible engagement and disengagement of the trolling motor. Even small savings of time during such operation may be critical to the success of a professional fisherman participating in a timed event or tournament.

Breakaway unit 3 of the preferred embodiment illustrated in FIG. 1 rides atop breakaway base 5. Breakaway unit 3 is held in place on top of breakaway base 5 by means of the force exerted by spring 8. Spring 8 sits on top of breakaway unit 3 and is held in place by nut/bolt assembly 9, which extends upward from breakaway base 5 through breakaway unit 3. Any other type of shaft assembly or other connection means for spring 8 could be used in alternative embodiments. Three cams 6 (only one is shown in FIG. 1) extend from the top of breakaway base 5 and fit within corresponding notches in breakaway unit 3. These three cams 6 are positioned with one to either side of breakaway base 5, and one to the front of breakaway base 5, that is, to that end of breakaway base 5 opposite to shaft 1. It may be seen, however, that in alternative embodiments, other positioning and number of cams 6 may be employed. Likewise, pins or other means could be used in place of cams 6 to provide the functionality of seating breakaway unit 3 with respect to breakaway base 5. Breakaway base 5 is connected to the boat by means of base plate 10. Pivot pin 7 through breakaway base 5 is used to load the unit onto the boat in a horizontal position if desired, such as for transport of the boat by trailer or storage of the boat out of the water.

It may be seen that the described preferred embodiment provides significant protection for the trolling motor should the propulsion unit of the trolling motor strike an underwater obstacle during movement. The tension in spring 8 forces cams 6 of break away base 5 into the corresponding notches in breakaway unit 3. This force may be overcome, however, by a countervailing force due to the resilience of spring 8. When an underwater obstacle is struck, breakaway unit 3 may shift up and to the left or right, opposite to the direction of the force, thus allowing the propulsion unit to deflect over or around the obstacle. This causes compression of spring 8. After the propulsion unit deflects upon impact, the force of spring 8 will cause breakaway unit 3 to settle back into position on breakaway base 5, guided into position by cams 3. As a result, the propulsion unit will automatically resume its previous depth and position with respect to the boat after the obstacle is cleared. The operator is alerted to the fact that an obstacle was struck even if the impact was not sufficiently significant to be felt as a vibration in the boat, because the deflection of the trolling motor resulting from the impact will be easily visible. The operator may then slow the boat, maneuver, or take other appropriate measures in response to the presence of the underwater obstacle.

It may be seen that while in the preferred embodiment the invention is envisioned for use with conventional trolling motors, the invention could in alternative embodiments be implemented as a single unit with a trolling motor designed specifically for such purpose. In one variation of this alternative embodiment, the trolling motor shaft 1 could itself include a vertically disposed rack similar to that of rack unit 2 as shown in FIG. 1, thereby eliminating the need for a separate rack unit 2 that is clamped to shaft 1. Electrical controls for the trolling motor and the raising/lowering mechanism operated by means of gear 4 could optionally be integrated in this alternative embodiment.

As used herein, "comprising" is synonymous with "including," "containing," or "characterized by," and is inclusive or open-ended and does not exclude additional, unrecited elements or method steps. As used herein, "consisting of" excludes any element, step, or ingredients not specified in the claim element. As used herein, "consisting essentially of" does not exclude materials or steps that do not materially affect the basic and novel characteristics of the claim. Any recitation herein of the term "comprising", particularly in a description of components of a composition or in a description of elements of a device, is understood to encompass those compositions and methods consisting essentially of and consisting of the recited components or elements. The invention illustratively described herein suitably may be practiced in the absence of any element or elements, limitation or limitations which is not specifically disclosed herein.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Thus, additional embodiments are within the scope of the invention and within the following claims.

In general the terms and phrases used herein have their art-recognized meaning, which can be found by reference to standard texts, journal references and contexts known to those skilled in the art. The preceding definitions are provided to clarify their specific use in the context of the invention.

All patents and publications mentioned in the specification are indicative of the levels of skill of those skilled in the art to which the invention pertains. All references cited herein are hereby incorporated by reference to the extent that there is no inconsistency with the disclosure of this specification.

The present invention has been described with reference to certain preferred and alternative embodiments that are intended to be exemplary only and not limiting to the full scope of the present invention as set forth in the appended claims.

The invention claimed is:

1. A trolling motor support assembly for a trolling motor comprising a trolling motor propulsion unit and trolling motor shaft, the support assembly comprising:

(a) a rack unit attached to the trolling motor shaft, wherein the rack unit comprises a vertically disposed rack;

(b) a breakaway unit comprising a gear engaged with the rack of the rack unit, whereby rotation of the gear causes the trolling motor shaft to raise or lower depending upon a direction of rotation of the gear; and (c) a breakaway base beneath the breakaway unit, wherein the breakaway unit and breakaway base are resiliently engaged with each other and further wherein the breakaway unit is configured to pivot with respect to the breakaway base in any direction in response to a torque applied to the trolling motor shaft, such that the trolling motor propulsion unit may deflect if it strikes an underwater obstacle from any direction, wherein one of the breakaway base and the breakaway unit further comprises at least one cam not in contact with the trolling motor shaft, and wherein the other one of the breakaway base and the breakaway unit further comprises at least one notch sized to receive the at least one cam.

2. The support assembly of claim 1, wherein the breakaway unit further comprises a gear motor driving the gear.

3. The support assembly of claim 1, further comprising a resilient member positioned to exert downward force on the breakaway unit, thereby holding the breakaway unit in place with respect to the breakaway base.

4. The support assembly of claim 3, wherein the resilient member is a spring.

5. The support assembly of claim 4, further comprising a spring mounting assembly engaged with the breakaway base, wherein the spring mounting assembly holds the spring in place against the breakaway unit.

6. The support assembly of claim 5, wherein the spring mounting assembly comprises a vertical shaft extending through a center of the spring.

7. The support assembly of claim 1, further comprising a base plate engaged with a boat and with the breakaway base.

8. The support assembly of claim 7, further comprising a pivot pin connecting the base plate and the breakaway base.

9. A drive assembly for a boat, comprising:

(a) a trolling motor comprising a trolling motor shaft and a trolling motor propulsion unit, wherein the trolling motor shaft comprises a vertically disposed rack;

(b) a breakaway unit comprising a gear engaged with the trolling motor shaft rack, whereby rotation of the gear causes the trolling motor shaft to raise or lower depending upon a direction of rotation of the gear; and (c) a breakaway base beneath the breakaway unit, wherein the breakaway unit and breakaway base are resiliently engaged with each other and further wherein the breakaway unit is configured to pivot with respect to the breakaway base in any direction in response to a torque applied to the trolling motor shaft, such that the trolling motor propulsion unit may deflect if it strikes an underwater obstacle from any direction, wherein the breakaway base further comprises at least one engaging member not in contact with the trolling motor shaft, and wherein the breakaway unit further comprises at least one receiving member sized to receive the at least one engaging member.

10. The drive assembly of claim 9, wherein the breakaway unit further comprises a gear motor driving the gear.

11. The drive assembly of claim 10, further comprising a resilient member operable to urge the breakaway unit toward the breakaway base and the engaging member into position with respect to the receiving member.

12. The drive assembly of claim 11, wherein the resilient member is a spring.

13. The drive assembly of claim 12, further comprising a spring mount engaged with the breakaway base and extending through the breakaway unit, wherein the spring mount holds the spring in an engaged position with the breakaway unit.

14. The drive assembly of claim 13, wherein the spring mount comprises a vertical shaft extending through the spring.

15. The drive assembly of claim 9, further comprising a base plate engaged with a boat and with the breakaway base.

16. The drive assembly of claim 15, further comprising a pivot pin hingeably connecting the base plate and the breakaway base.

17. A trolling motor support assembly for a trolling motor comprising a trolling motor shaft, comprising:

(a) a rack connected to the trolling motor shaft, wherein the rack comprises a plurality of vertically disposed teeth;

(b) a gear engaged with the teeth of the rack;

(c) a gear motor engaged with the gear whereby the gear motor may drive the gear rotationally;

(d) an electrical control system in communication with the gear motor, wherein the electrical control system is operable to turn the gear and to control the direction in which the gear is turned;

(e) a breakaway unit housing the gear and the gear motor;

(f) a breakaway base positioned beneath the breakaway unit;

(g) a plurality of cams extending upward from the breakaway base;

(h) a plurality of notches on the breakaway unit positioned to each receive one of the plurality of cams extending upward from the breakaway base;

(i) a spring retaining assembly extending upward through the breakaway unit from the breakaway base;

(j) a spring engaged with the spring retaining assembly wherein the spring is operable to urge the breakaway unit downward such that the cams of the breakaway base are engaged with the notches of the breakaway unit and further wherein the breakaway unit is operable to pivot with respect to the breakaway base in any direction in response to a torque applied to the trolling motor shaft;

(k) a base plate positioned beneath the breakaway base and attached to a boat; and (l) a pivot pin hingeably engaging the base plate to the breakaway base, whereby the trolling motor assembly is operable to be lifted and rotated onto the boat with the trolling motor shaft in a horizontal position.

* * * * *